US008337170B2

(12) United States Patent
Abdullah

(10) Patent No.: US 8,337,170 B2
(45) Date of Patent: Dec. 25, 2012

(54) SYSTEM FOR RAISING WATER FROM AN UNDERGROUND SOURCE

(76) Inventor: Mohammad A. Abdullah, Al Dasma (KW)

( * ) Notice: Subject to any disclaimer, the term of this patent is extended or adjusted under 35 U.S.C. 154(b) by 352 days.

(21) Appl. No.: 12/694,439

(22) Filed: Jan. 27, 2010

(65) Prior Publication Data

US 2011/0182755 A1 Jul. 28, 2011

(51) Int. Cl.
*F24J 2/00* (2006.01)

(52) U.S. Cl. ..... 417/207; 126/569

(58) Field of Classification Search ..... 417/379, 417/278, 207, 208, 209; 126/569
See application file for complete search history.

(56) References Cited

U.S. PATENT DOCUMENTS

| | | | | |
|---|---|---|---|---|
| 776,106 | A * | 11/1904 | Beuirrier | 417/149 |
| 2,688,923 | A | 9/1954 | Bonaventura et al. | |
| 3,965,972 | A | 6/1976 | Petersen | |
| 4,197,060 | A * | 4/1980 | Chadwick | 417/379 |
| 4,326,923 | A | 4/1982 | Mortenson | |
| 4,439,111 | A | 3/1984 | Seidel et al. | |
| 4,519,749 | A * | 5/1985 | Baumberg | 417/158 |
| 4,802,829 | A * | 2/1989 | Miller | 417/12 |
| 4,884,953 | A | 12/1989 | Golben | |
| 5,043,061 | A * | 8/1991 | Inagaki | 210/151 |
| 7,201,333 | B2 * | 4/2007 | Yoshikawa et al. | 239/565 |
| 2004/0219039 | A1 * | 11/2004 | Watt | 417/411 |
| 2009/0260622 | A1 * | 10/2009 | Palkes et al. | 126/610 |

FOREIGN PATENT DOCUMENTS

| | | | |
|---|---|---|---|
| CN | 201000211 Y | * | 1/2008 |
| DE | 4107099 A1 | * | 9/1992 |
| GB | 2211555 A | * | 7/1989 |

OTHER PUBLICATIONS

Ludwig, Ferror Cement Tanks for Water Storage: Design, Tools, Materials, and Construction, 2005 (www.oasisdesign.com).*

* cited by examiner

*Primary Examiner* — Devon Kramer
*Assistant Examiner* — Nathan Zollinger
(74) *Attorney, Agent, or Firm* — Lowe Hauptman Ham & Berner, LLP

(57) ABSTRACT

A system for raising water from an underground source of water to an aboveground tank includes a plurality of capillary tubes for raising water from the underground source to a first water level, a pipe for raising water from the first water level to an above ground tank, the aboveground tank is painted black to absorb the sun's rays and is tilted with an elevated proximal end so that water in the tank runs down to its distal end. A tap is provided in the distal end for drawing water out of the tank. The tank also includes two one way valves, one in an upper portion of the distal end for allowing heated air to escape and one in a lower portion of the distal end to allow water to be drawn up into the tank as heated air cools. A solar powered rechargeable battery can be used to power a positive displacement pump.

1 Claim, 1 Drawing Sheet

SYSTEM FOR RAISING WATER FROM AN UNDERGROUND SOURCE

FIELD OF THE INVENTION

This invention relates to a system for raising water from an underground source and more particularly to a system for raising water from an underground source to an aboveground storage tank with a minimum of non-renewable energy.

BACKGROUND FOR THE INVENTION

Capillary action for the movement of liquids in thin tubes is well known and has been understood for many years. For example, the height h of a liquid column can be determined by the following formula wherein $$h = \frac{2\gamma\cos\theta}{pgr}$$

γ is the liquid-air surface tension (energy/area)
θ is the contact angle
p is the density of liquid (mass/volume)
g is acceleration due to gravity (length/time$^2$)
r is radius of tube (length)

As a result:
γ is 0.0728 J/M$^2$ at 20° C.
θ is 20° C. (0.35 rad)
p is 1000 kg/m$^3$
g is 9.8 m/s$^2$ Thus, the height of h is $$h \approx \frac{1.4\times10^{-5}\ \mathrm{m}^2}{r}$$

and
for a 0.2 mm wide (0.0001 m radius tube) the water would rise about 5.5 inches.

Solar powered pumps are also well known and have been in use for many years. For example a solar energy pump is disclosed in a U.S. Pat. No. 2,688,923 of Bonaventure et al. As disclosed, when the sun's rays are reflected from a reflector and condensed into a concentrated area upon a boiler, the heat concentrated in the boiler causes expansion of water creating pressure which forces the water upward through a fluid transfer tube. As the water in the boiler is reduced in volume, steam is created which passes downwardly through the conduits and into a chamber. This permits the steam to force the water downward and outside through a water delivery tube.

A more recent patent of Chadwick, U.S. Pat. No. 4,197,060 discloses a heat or solar powered water pump that includes a flexible diaphragm on the pumping element with a volatile liquid as the working fluid. The flexible diaphragm is enclosed within a vessel and isolates the working fluid from the water to be pumped. A U-shaped siphon tube acts as a temporary reservoir for the pumped water and is siphoned empty after being filled. A portion of the water siphoned from the U-shaped siphon tube is re-circulated through the vessel in heat exchange relationship with the working fluid to condense the working fluid. A reservoir of warm water is maintained in thermal contact with the flexible diaphragm to minimize condensation of the working fluid by thermal contact with the water through the diaphragm.

In addition, a solar pumping installation for pumping liquid and solar collector construction are disclosed in a U.S. Pat. No. 4,439,111 of Seidel et al. As disclosed, a solar pumping system comprises a pumping housing which defines a pump chamber therein which is adapted to be positioned in the ground below ground water level. A dispenser in the form of a bladder, arranged within the pump chamber is capable of displacing the liquid out of the pump chamber in response to a pressurized medium acting thereon to expel the water out of the chamber and up to a level above the ground for use. A suction valve connected into the chamber permits the ground water to flow into the chamber and a discharge valve connected out of the chamber permits the outflow of the ground water during the action of the displacer. The construction includes a solar collector having at least one hydride conduit which is adapted to be exposed to the sun for solar heating to act on the hydride to cause hydrogen to be formed, the pressure of which acts against the displacer to displace the ground liquid out of the pump chamber when the solar collector is shielded and the hydride is permitted to cool or is cooled rapidly by the circulation of water thereover the pressure of the generated hydrogen decreases permitting ground water to enter into the pumping chamber once again through the suction valves.

Notwithstanding the above it is presently believed that there is a need and a potential commercial market for a system for raising water from an underground source to an aboveground storage tank with a minimum of non-renewable energy. There should be a demand because in many places there is an abundance of underground water and yet electricity in those areas is not always readily available. Thus, the water becomes useless if it cannot be raised. Thus, there is a need for a system to raise underground water to an aboveground storage tank and to do so with a minimal use of non-renewable energy. In the present invention, a pipe is extended into the ground to reach the water and during the day the sun heats the tank and the air inside thereof. The air will expand and some of it will escape through a valve. On the other hand when the valve is closed the night air cools the heated air and forces the initial valve to close and a second valve to open. Then water rises up through the pipe reaching the tank and excessive water will settle in the tank. At the same time capillary tubes have been added to naturally raise the level of water to a first level which helps the contracting air to raise the water into the tank. Further, one or more mirrors are used to increase the heat applied to the air in the storage tank to increase its expansion.

BRIEF SUMMARY OF THE INVENTION

In essence, a system for raising water from an underground source of water to an aboveground storage tank includes an aboveground sealible storage tank that includes an upper surface exposed to the sun and a lower surface. A proximal end of the tank is adapted for receiving water from the underground source and a distal end includes a tap for discharging water from the storage tank and wherein the proximal end of the storage tank is somewhat higher than the distal end so that water from the underground source flows downwardly and accumulates in the distal end of the storage tank. A heat absorbable coating is applied on at least an upper surface of the storage tank for absorbing heat from the sun to thereby heat the air in the storage tank and one or more mirror are applied for reflecting sunlight and focusing the sunlight on the heat absorbing coating. In addition a first one way valve in an upper portion of the storage tank at a proximal portion thereof is provided for allowing heated air to escape from the storage tank when the sun rays are incident upon or reflected on to the heat absorbing coating and the first one way valve is closeable when the sun rays are no longer incident upon or reflected onto the heat absorbing coating whereby the contraction of the heated air as it cools draws water upwardly into the storage tank. The system also includes a second one way valve in a lower portion of the storage tank near the proximal end and wherein the second one way valve is closeable when the sun rays are incident upon or reflected onto the heat absorbable coating and openable when the sun rays are no long incident upon or reflected onto the heat absorbable coating so that the contraction of the cooling air draws water into the storage tank. Further, the system includes a plurality of capillary tubes extending upwardly from the underground source of water to a first level for drawing water from the underground source upwardly to the first level. A pipe extends upwardly from the first level to the storage tank to thereby raise water from the first level through the second one way valve and into the storage tank as a result of the contraction of the heated air as it cools with the first one way valve in a closed position and the second one way valve in an open position.

In a preferred embodiment of the invention the system for raising water from an underground source of water to an aboveground storage tank also further includes a rechargeable battery, a separate array of solar cells for generating electricity to charge the rechargeable battery and a positive displacement water pump for raising water from the first level to the storage tank during periods when the suns rays are insufficient to raise the water into the storage tank without the aid of the positive displacement pump.

The invention will now be described in connection with the accompanying drawings wherein like reference numerals have been used to indicate like parts.

DESCRIPTION OF THE PREFERRED EMBODIMENTS OF THE INVENTION

Figure 1:
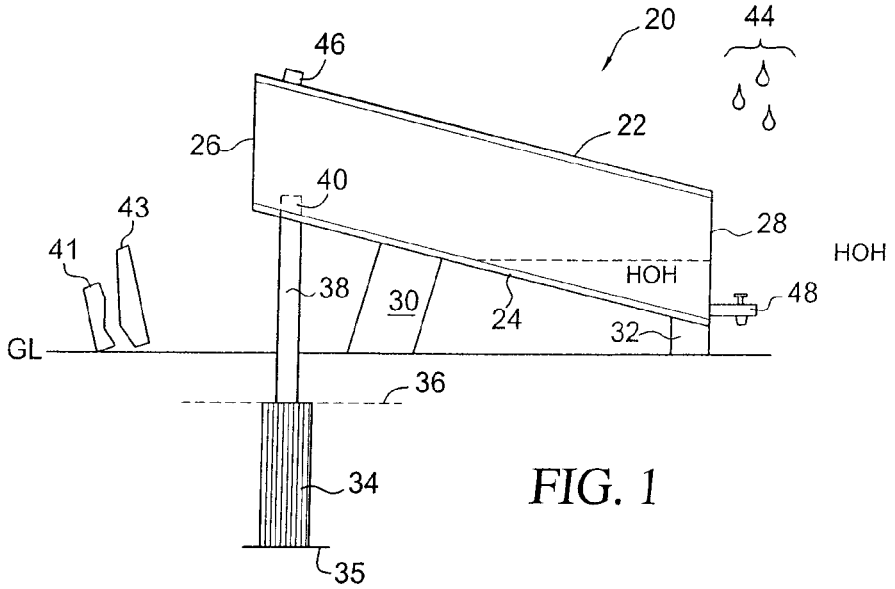
FIG. 1 is a schematic illustration of a solar water pump in accordance with a first embodiment of the invention.
Figure 2:
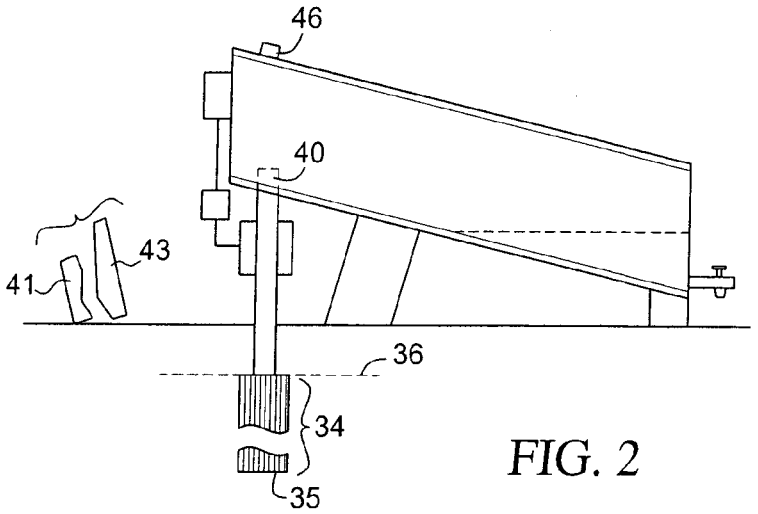
FIG. 2 is a schematic illustration of a water pump in accordance with a second embodiment of the invention.
Figure 3:
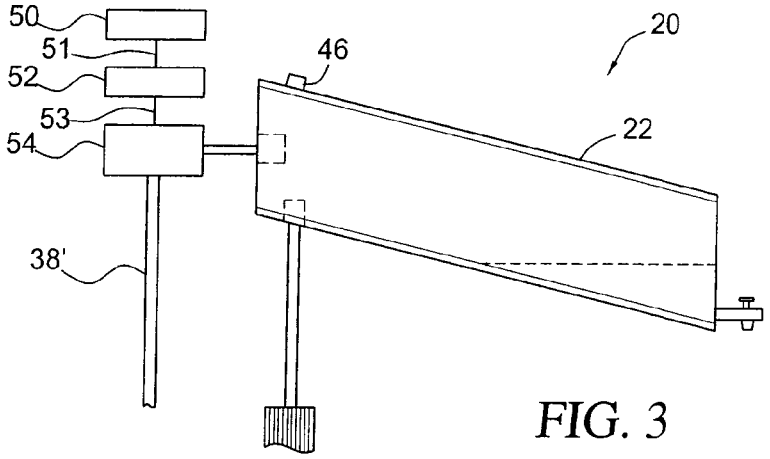
FIG. 3 a schematic illustration of a water pump in accordance with a third embodiment of the invention

As illustrated in FIGS. 1 and 2 a system for raising water from an underground source of water to an aboveground storage tank includes an aboveground generally cylindrical storage tank 20 that includes an upper heat absorbing coating 22 such as a coating of black paint on an aluminum body and a lower coating 24 on a lower surface thereof. The tank 20 also includes a proximal end 26 and a distal end 28. As illustrated the proximal end 26 is elevated above the level of the distal end 28 so that water entering the tank 20 at the proximal end 26 runs down toward the distal end 28 and is accumulated in a lower portion of the tank 20. Supports 30 and 32 maintain the proximal end 26 elevated above the level of the distal end 28.

The system for raising water from an underground source of water also includes an array of upwardly extending capillary tubes 34 that connect an underground source of water 35 to a first water level 36. An upwardly extending pipe 38 connects the first water level 36 with a proximal end 26 of the tank 20 through a first one way valve 40. This first one way valve 40 allows water to flow into the storage tank 20 and prevents water or air from passing through the valve 40. A plurality of mirrors as for example, a pair of mirrors 41 and 43 reflects and preferably focus sun light onto the lower coating 24 to aid in heating the air and water in the tank 20. The sun's rays striking the upper heat absorbing coating 22 also raises the temperature of the air and water in the storage tank 20. It is also contemplated that a plurality of lenses f44 may be disposed above the tank 20 for focusing the sun's rays on the upper heat absorbing layer or coating 22 for increasing the heat within the tank 20.

During the heat of the day, the sun's rays raise the temperature of the water and air in the storage tank 20 while a second one way valve 46 allows excess heated air to escape from the storage tank 20 to thereby relieve pressure within the tank 20. The one way valve also prevents air from being drawn into the tank 20. Then, as the sun sets the coolness of the night air surrounding the storage tank 20 will cause cooling previously heated air to contract and thereby cause the water from the first water level 36 to be drawn upwardly through the pipe 38 and first one way valve 40 and into the storage tank 20. A tap 48 in the distal end 28 is provided for draining water out of the tank 20.

FIG. 2 illustrates a second embodiment of the invention whereby the storage tank 20 includes first and second one way valves 40 and 46 at or near the proximal end 26 of tank 20 in a lower portion and upper portion respectively. However, in the second embodiment of the invention the storage tank 20 includes an array of photocells 50 that generate electrical energy in response to being struck by the sun's rays. The array of photocells are connected to a rechargeable battery 52 by an electric wire 53 that connects an output of the photo electric cells 50 to the rechargeable battery 52. The rechargeable battery is connected to a positive displacement pump 54 to power the pump 54 to raise additional water through the pipe 38 and first one way valve 40.

It is also contemplated that a second pipe and one way valve can be used to transfer water from the first water level 36 and into the tank 20. For example, the positive displacement pump 54 can be used to raise an additional volume of water into the tank 20.

While the invention has been described in accordance with its preferred embodiments it should be recognized that changes and modifications may be made therein without departing from the scope of the appended claims.

What is claimed is:

1. A system for raising water from an underground source of water to an aboveground storage tank consisting of:

an aboveground sealable storage tank including an upper surface exposed to the sun and a lower surface;

a proximal end for receiving water from the underground source and a distal end including a tap for discharging water from said storage tank and wherein said proximal end of said storage tank is elevated above said distal end so that water from said underground source accumulates in said distal end of said storage tank;

a plurality of mirrors for reflecting the sun's rays onto said storage tank;

a heat absorbing coating of black paint on said upper and lower surface of said storage tank for absorbing heat from the sun's rays and from said plurality of mirrors to thereby heat the air in said storage tank said plurality of mirrors for focusing sunlight onto said lower surface of said storage tank;

a first one way valve in an upper portion of said storage tank near said proximal end thereof for allowing air to escape from said storage tank when the sun's rays are incident upon and reflected onto said heat absorbing coatings and said first one way valve closeable when said sun's rays are no longer incident upon or reflected onto said heat absorbing coatings whereby the contraction of the heated air on cooling draws water upwardly from a first level and into said storage tank; and a second one way valve in a lower portion of said storage tank near said proximal end thereof and connecting an upwardly extending pipe in said storage tank, wherein said second one way valve is closeable when said sun's rays are incident upon or reflected on to said heat absorbing coatings and open when the sun's rays are no longer incident upon or reflected onto said heat absorbing coatings so that the contraction of the cooling air draws water upwardly from said first level and into said storage tank;

a plurality of capillary tubes extending upwardly to said first level for drawing water from an underground source upwardly to said first level and said pipe extending upwardly from said first level to said storage tank to thereby raise water from said first level through said second one way valve and into said storage tank when said first one way valve is closed and said second one way valve is open; and, said system further consisting of;

a battery, an array of solar cells for charging said battery and a positive displacement pump raising water upwardly to increase the volume of water resulting from cooling of heated air.

* * * * *